US007709758B2

(12) United States Patent
Curnis et al.

(10) Patent No.: US 7,709,758 B2
(45) Date of Patent: May 4, 2010

(54) CIRCUIT BREAKER WITH INTERCHANGEABLE OPERATING MECHANISM AND SUSPENDED MOBILE CONTACT ASSEMBLY

(75) Inventors: Maurizio Curnis, Carvico (IT); Daniela Olivieri, Cinisello Balsamo (IT)

(73) Assignee: ABB S.p.A., Milan (IT)

( * ) Notice: Subject to any disclaimer, the term of this patent is extended or adjusted under 35 U.S.C. 154(b) by 186 days.

(21) Appl. No.: 11/913,923

(22) PCT Filed: May 3, 2006

(86) PCT No.: PCT/EP2006/062004

§ 371 (c)(1),
(2), (4) Date: Nov. 8, 2007

(87) PCT Pub. No.: WO2006/120141

PCT Pub. Date: Nov. 16, 2006

(65) Prior Publication Data

US 2008/0185275 A1 Aug. 7, 2008

(30) Foreign Application Priority Data

May 13, 2005 (IT) ..... BG2005A0025

(51) Int. Cl.
*H01H 1/22* (2006.01)

(52) U.S. Cl. ..... 200/244; 200/329

(58) Field of Classification Search ..... 200/400, 200/17 R, 329, 335, 339, 244
See application file for complete search history.

(56) References Cited

U.S. PATENT DOCUMENTS

| | | | | |
|---|---|---|---|---|
| 4,764,650 | A | 8/1988 | Bur et al. | |
| 5,479,143 | A * | 12/1995 | Payet-Burin | 335/202 |
| 5,539,167 | A * | 7/1996 | Hood et al. | 200/244 |
| 2004/0256207 | A1 | 12/2004 | Azzola et al. | |
| 2008/0185280 | A1 * | 8/2008 | Bresciani et al. | 200/400 |
| 2008/0210532 | A1 * | 9/2008 | Besana et al. | 200/244 |

FOREIGN PATENT DOCUMENTS

| | | |
|---|---|---|
| EP | 0 490 332 A | 6/1992 |
| GB | 2 006 527 A | 5/1979 |

* cited by examiner

*Primary Examiner*—Edwin A. Leon
*Assistant Examiner*—Vanessa Girardi
(74) *Attorney, Agent, or Firm*—Connolly Bove Lodge & Hutz LLP; Arlene P. Neal

(57) ABSTRACT

The present invention relates to a single-pole or multi-pole switch to be used preferably in low-voltage systems. The switch (1) comprises an outer casing (2) containing for each pole at least one fixed contact (10) and one mobile contact (20) which can be reciprocally coupled to/uncoupled from each other. The mobile contacts (20) are housed in suitable seats (25) provided on a mobile element (50). The switch (1) according to the invention is provided with a control mechanism (60, 61) comprising mechanical means supported by a structural part (70). This control mechanism (60, 61) is connected to the mobile element (50) through first removable connection means (64) and to the outer casing (2) through second removable connection means (65). The switch (1) also comprises means to support the mobile element (50) which are connected to the structural part (70) of the control mechanism (60, 61) through third removable connection means (66).

21 Claims, 13 Drawing Sheets

CIRCUIT BREAKER WITH INTERCHANGEABLE OPERATING MECHANISM AND SUSPENDED MOBILE CONTACT ASSEMBLY

CROSS-REFERENCE TO RELATED APPLICATIONS

This application is a national stage application (under 35 U.S.C. §371) of PCT/EP2006/062004 filed May 3, 2006, which claims benefit of Italian application BG2005A000025 filed May 13, 2005, disclosure of which are incorporated herein by reference.

The present invention relates to a low-voltage switch with improved characteristics of interchangeability of the control, of maintenance and modification of performances and of operating configurations.

The term switch is intended as a switching device provided with protective means which cause automatic breaking in the presence of specific conditions of overload, short circuit or other electrical faults.

It is known that automatic switches and other switching devices include one or more electrical poles, associated with each of which is at least one fixed contact and at least one mobile contact which can be reciprocally coupled to/uncoupled from each other. Throughout the description the expression switch will be used to indicate without distinction an automatic switch or other types of switching devices.

Switches also comprise control means which allow movement of the mobile contacts, causing coupling and uncoupling of the corresponding fixed contacts.

The action of these control means on the mobile contacts generally takes place through a main shaft operatively connected to the mobile contacts or through the use of a mobile element from which said mobile contacts directly extend. The operative connection between said control and said main shaft or said mobile element takes place conventionally by means of a kinematic chain.

However, switches of known type have various drawbacks. Some of these derive from the fact that, normally, the operative connection between the control and the mobile element or main shaft requires a relatively high number of connecting means which are difficult to access and therefore difficult for an operator to replace when required. In fact, as is known, during the operating life of the switch, each of its components is virtually subject to deterioration or wear due, for example, to the considerable thermal and mechanical stresses to which the automatic switch or disconnector is normally subjected, during switching movements or tripping due to short circuit. However, the operating efficiency of the switch depends on the perfect state of preservation of all its parts. Therefore, on the basis of the state of effective efficiency, it may be necessary to carry out difficult and costly maintenance operations.

In particular, it is currently possible to replace or disassemble parts of the switch control only through specific working procedures which are outside the normal field of an operator in charge of maintenance.

As is known, the performances of the switch are closely related to the performances of each component, and in particular of the control, which on the basis of the power that can be stored in its storage members, allows, for example, improved dynamic response values which translate into higher values of making capacity and/or breaking capacity. In the case in which different plant engineering requirements become necessary, such as the necessity to benefit from the advantages of a storage control (i.e. from a servomotor remote control) and of a higher making or breaking capacity, in almost all current solutions it is necessary to replace the entire apparatus. Obviously, this limit has negative repercussions on the overall manufacturing and operating costs of the low-voltage switch.

Another drawback of conventional switches is represented by their functional rigidity, i.e. the fact that they can only be used correctly in limited ranges of application, with particular reference to the type of operating configuration of the control (direct or storage), the making capacity and the breaking capacity. In particular, for each application the switch must be fitted with a specific control which responds efficiently to the operating conditions. When these conditions vary, currently it is not possible to replace the control alone in order for the switch to be operative, but is almost always necessary to replace the entire switch. In substance, current technical solutions do not allow interchangeability of the control by an operator in charge of maintenance, as the work procedures require the use of industrial type equipment and specific knowledge of the complex connection, fastening and regulation operations.

On the basis of these considerations, the main task of the present invention is to provide a switch, which allows the drawbacks described to be overcome.

Within this task, an object of the present invention is to provide a switch, with improved characteristics of interchangeability of the control.

Another object of the present invention is to provide a switch in which the operative connection between the control and the main shaft of the mobile contacts or mobile element can be produced in a simple and reliable manner, without complex connection, fastening and regulation operations.

A further object of the present invention is to provide a switch that has a reduced number of parts which are relatively simple to assemble and install.

Yet another object of the present invention is to provide a switch whose constituent parts are easy to inspect without complex maintenance procedures.

A still further object of the present invention is to provide a switch which is simple to produce, with moderate costs.

This task, these and other objects which will be more apparent hereunder are obtained by a low-voltage switch comprising:

- an outer casing containing for each pole at least one fixed contact and at least one mobile contact which can be reciprocally coupled to/uncoupled from each other,
- a mobile element defined by a shaped body comprising at least one seat for each pole of the switch, said seat being suitable to house the mobile contact of the relative pole;

The switch according to the invention is characterized by the fact that it comprises:

- first removable connection means which connect a control mechanism to the mobile element, said control mechanism comprising mechanical means supported by a structural part;
- second removable connection means which connect the structural part of the control mechanism to the outer casing;
- means to support the mobile element connected to the structural part of the control mechanism through third removable connection means, said supporting means being connected to the mobile element through a hinge connection.

The first, second and third removable connection means allow connection of the operating parts of the switch improving the characteristics of interchangeability of the control. These connection means can be positioned in or removed from their operating position without particular operations on the other constituent parts of the switch, with obvious advantages from a practical point of view.

Further characteristics and advantages will be more apparent from the description of a non-exclusive preferred embodiment of the switch according to the present invention, illustrated by way of a non-limiting example in the accompanying drawings, in which:

FIG. 1 schematically shows the structure of a switch according to the present invention;

Figure 1:
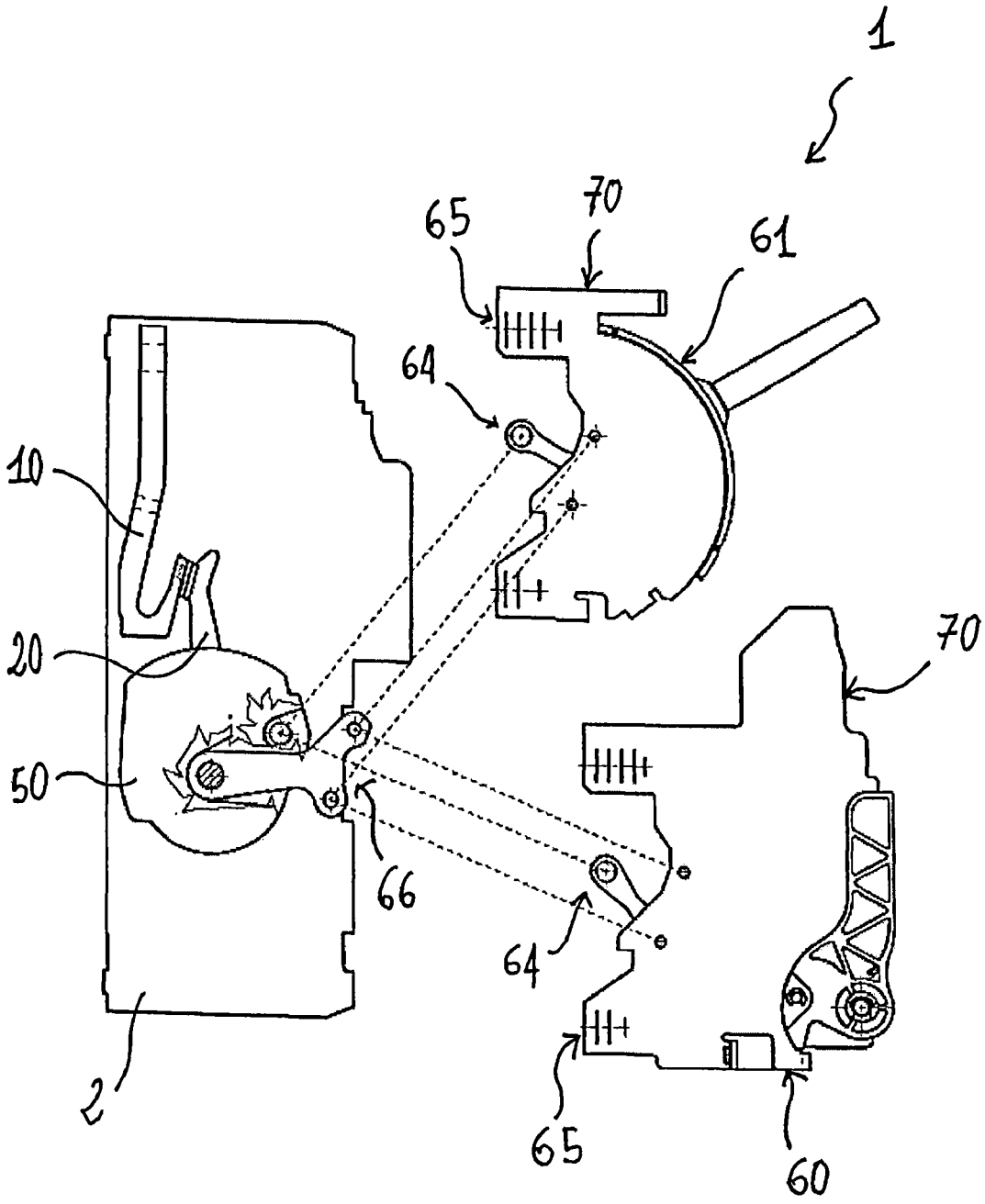

With reference to the aforesaid figures, the switch 1 according to the invention comprises an outer casing 2 containing one or more electrical poles, each defined by at least one fixed contact 10 which couples to/uncouples from at least one mobile contact 20. The outer casing 2 also houses a mobile element 50 composed of a shaped body made of insulating material, preferably thermosetting resin, which comprises at least one seat 25 for each pole of the switch 1.

The switch 1 is characterized in that it comprises first removable means 64 which connect a control mechanism 60 or 61 to the mobile element 50 in order to allow movement. The control mechanism 60 or 61 essentially comprises mechanical means supported by a structural part 70. This is connected to the outer casing 2 of the switch 1 through second removable connection means 65.

The switch 1 also comprises means to support the mobile element 50 which simultaneously provide a physical center for rotation of said element, utilizing a hinge connection illustrated hereunder in a possible embodiment thereof. The supporting means are connected to the control mechanism 60 or 61 and in particular to the structural part 70 thereof through third connection means 66, advantageously also removable.

FIG. 1 schematically shows a switch 1 according to the invention. As is evident, replacement of a first control mechanism 60 with a second of a different type 61 does not require disassembly of the entire switch 1, but the operation in question is performed simply by utilizing the first, 64, second 65 and third 66 removable connection means. The technical solutions employed and illustrated hereunder allow easy access to all the removable connection means, permitting operators to replace the control easily through simple and rapid operations.

Figure 2:
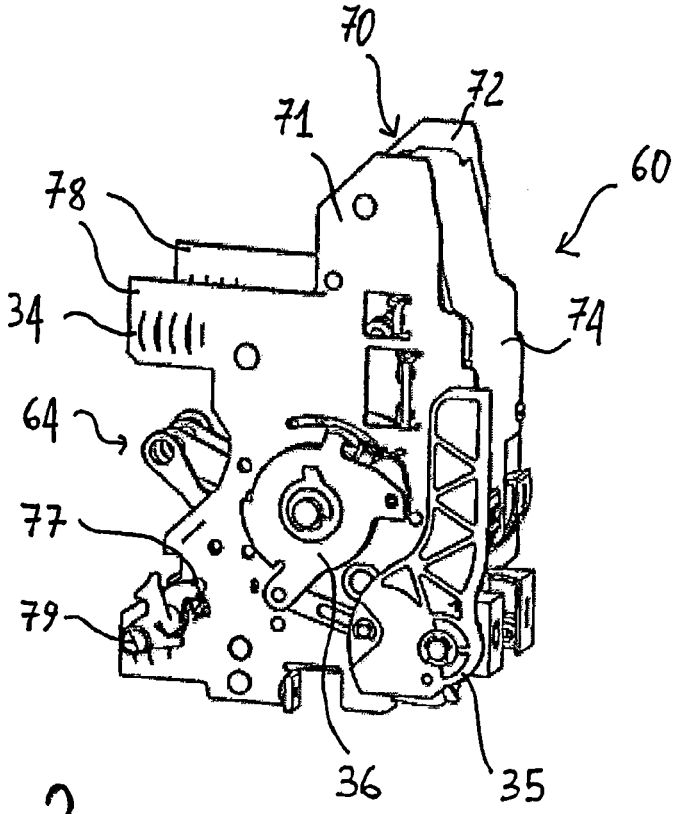
FIGS. 2 and 3 show perspective views respectively of a first and of a second possible embodiment of a control mechanism of a switch according to the invention.
Figure 3:
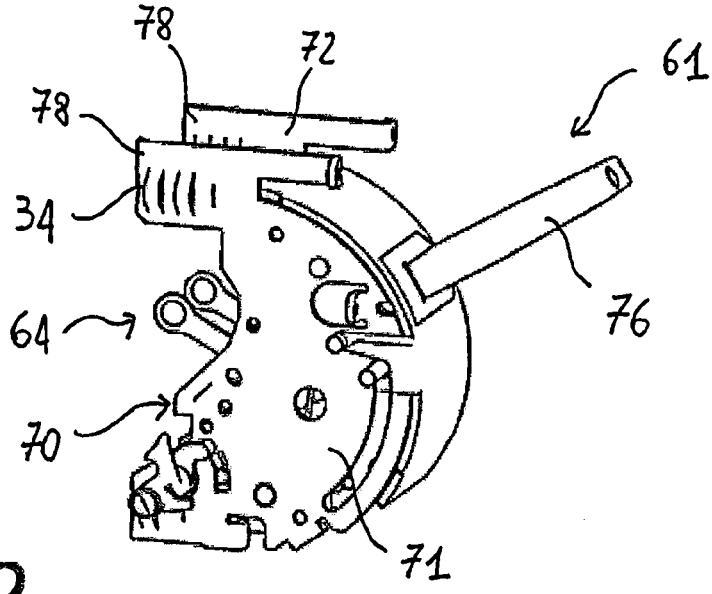
Figure 5:
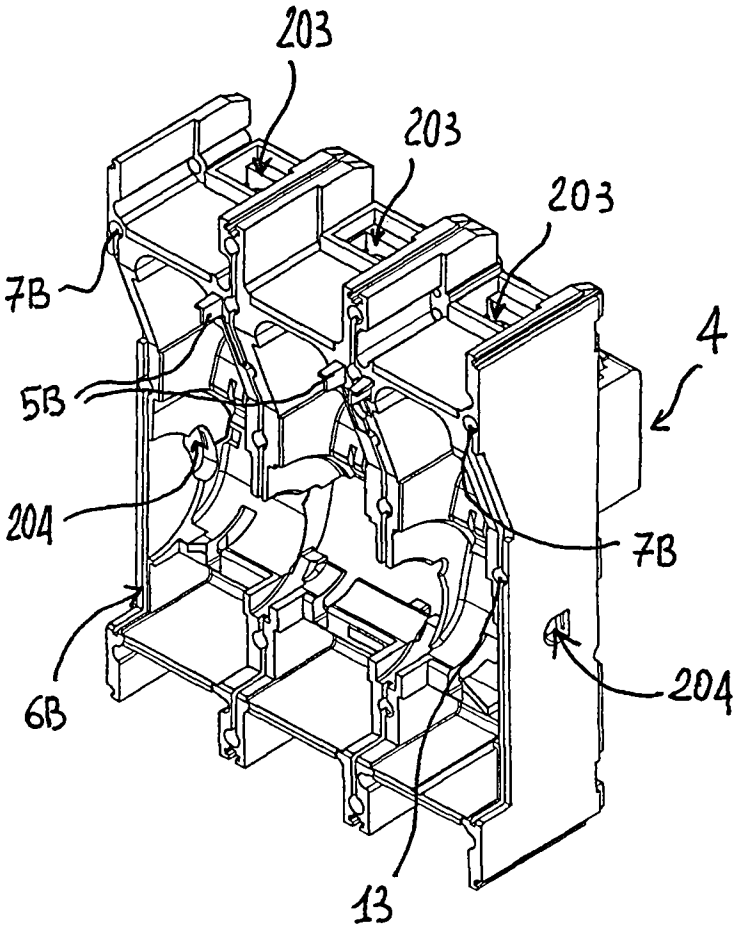
FIGS. 4 and 5 show first perspective views of component parts of an outer casing of a switch according to the invention.
Figure 4:
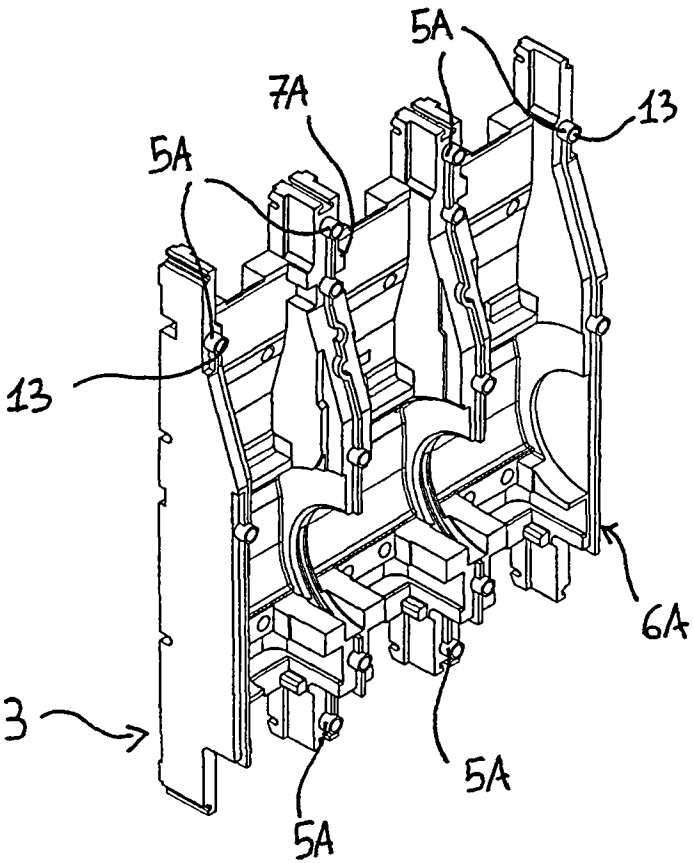

FIGS. 2 and 3 show two possible configurations of the control mechanism which will be used as references during the description. In particular, FIG. 2 relates to a control of the power storage type 60 normally used in applications which require, for example, high values of rated current, making capacity and/or the possibility of benefiting from servomotor remote controls. The structural part 70 of the mechanism 60 comprises a first side 71 and a second side 72 between which a transverse wall 74 is preferably interposed. At the side of this wall a loading lever 35 is positioned with the function of actuating a device 36 to load the springs of the kinematic means. In the solution shown, the first side 71 also comprises a side opening 77 positioned to allow passage of a signaling member 79 of the state of the switch 1.

FIG. 3 instead shows a control mechanism of the direct type 61 which is normally used for less complex plant engineering solutions. In this case, a control lever 76 is interposed between the two sides 71 and 72 of the structural part 70 for making, breaking or resetting the switch 1 by an operator. As will be illustrated hereunder, although having a different structural configuration from the power storage control 60, the direct control mechanism 61 is still connected to the other operating parts of the switch 1 according to the same assembly methods with obvious advantages.

FIGS. 4, 5, 6 and 7 are perspective views showing a possible embodiment of the outer casing 2 of the switch 1 according to the invention. This is preferably composed of a bottom 3 which couples to a lid 4 to produce volumes inside which the actual electrical components of the switch 1 are housed. The structure of the casing 2 can advantageously be completed through a protective mask 5 which is applied to the lid 4 and which can be easily removed by an operator to gain access to the internal parts of the switch 1.

The bottom 3 comprises a first coupling surface **6*a* emerging from which are a series of protrusions 5*a*, designed to be inserted in cavities 7*b* provided on a second coupling surface 6*b* of the lid 4. Similarly, also emerging from this second surface 6*b* are further protrusions 5*b*, which can be inserted in relative cavities provided on the first coupling surface 6*a*. In substance, the two coupling surfaces 6*a* and 6*b* have a shape at least partly geometrically corresponding which allows mutual penetration of the parts forming the casing 2**.

Figure 6:
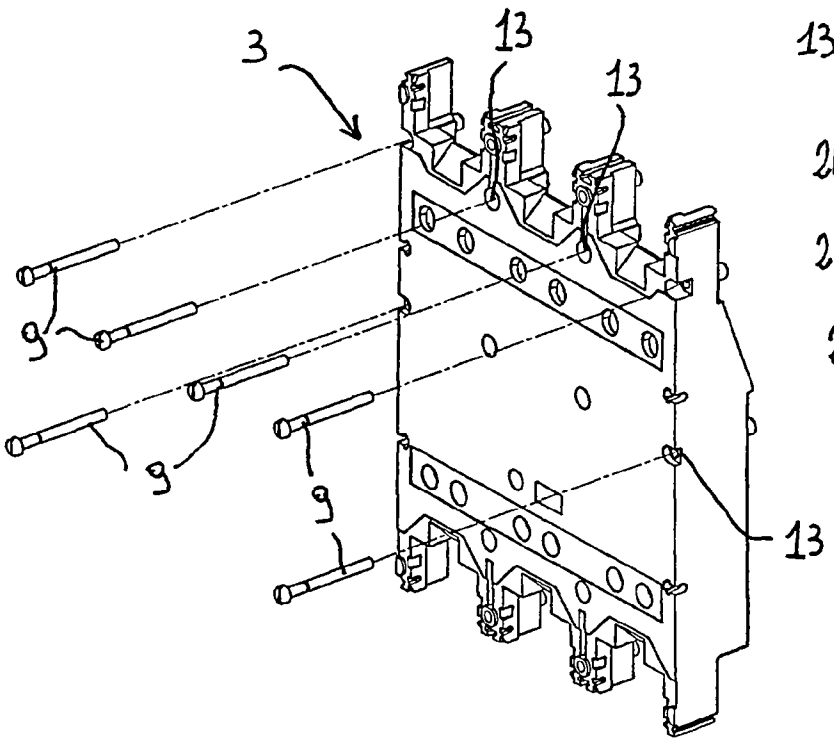

With reference to FIG. 6, constraint of the coupling is also guaranteed by a series of fastening screws 9 which ensure adequate resistance of the casing 2 to the stresses to which it is subjected during normal operation of the switch 1. As shown, the fastening screws 9 are inserted in holes 13 produced both on the bottom 3 and on the lid 4 and, alternatively, can be replaced by other functionally equivalent means, such as bolts or tie-rods.

Alternatively, the outer casing can be produced in metal sheet, as is commonly the case in switches of the "break" or "ACB" (air circuit breaker) type.

Figure 12:
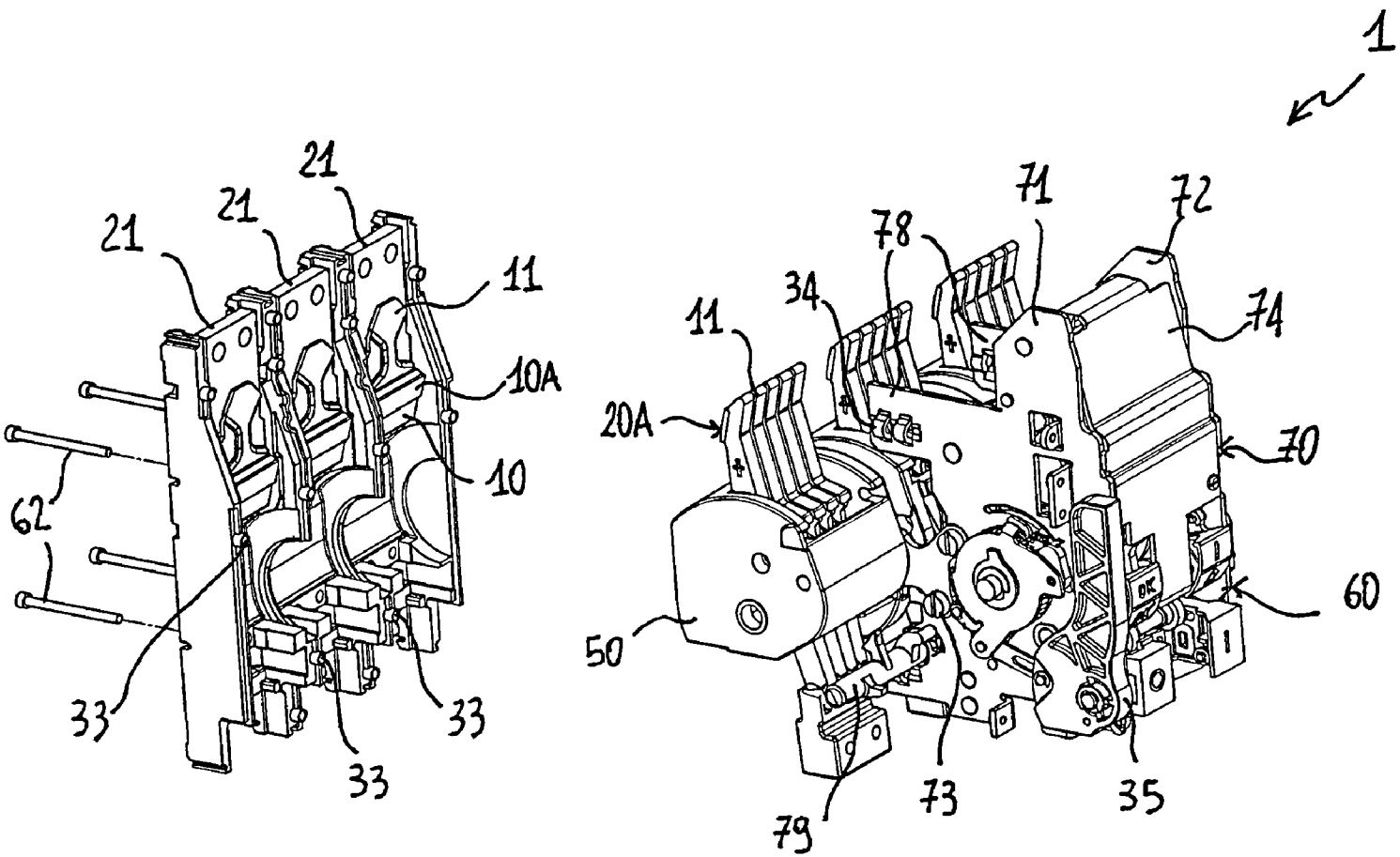
FIGS. 12 and 13 show respectively a first and a second exploded view of a first embodiment of a switch according to the invention.
Figure 15:
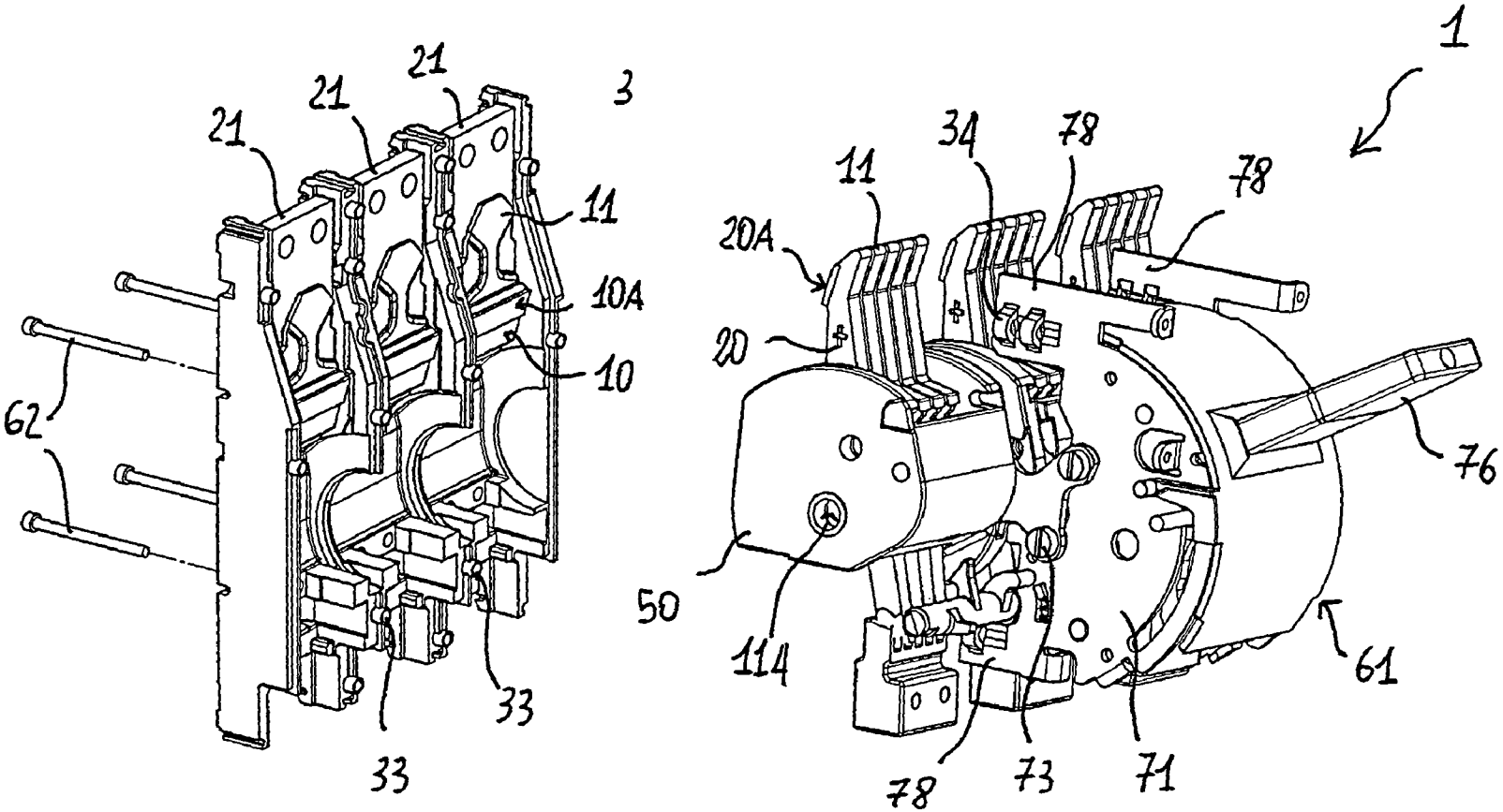
FIGS. 15 and 16 show respectively a first and a second exploded view of a second embodiment of the switch according to the invention.

FIGS. 12 and 15, which will be described in detail hereunder, show the internal side of the bottom 3, on which the fixed contacts 10, each electrically connected to an electrode 21, are provided. The fixed contacts 10 shown each comprise an active part **10*a* which comes into contact with a relative active part 20*a* provided on the mobile contacts 20. Both the fixed contacts 10 and the mobile contacts 20 can advantageously comprise an arc chute 11** which has the task of deflecting the electric arc in order to limit deterioration of the active parts of the contacts.

As known in the art, if metal casings are used, insulating elements are interposed between the fixed contacts and the casing.

With reference once again to FIG. 7, the lid 4 can advantageously be produced in an insulating material to improve electrical insulation between the metal parts forming the switch. When coupled to the bottom 3, the lid 4 produces at least one arc chamber 200 for each pole of the switch. Preferably, arc breaking elements are housed inside each arc chamber 200, with the function of facilitating quenching of the arc generated after separation of the contacts of the switch 1. Each arc chamber 200 comprises at least one upper opening 203 which forms the path for discharge of gases generated subsequent to creation of the electric arc. The lid 4 also has side openings 204 which allow an operator to gain access to the inside of the mobile element 50 and/or allow the passage of shafts or bars signaling the state (i.e. open, closed, tripped).

Figure 7:
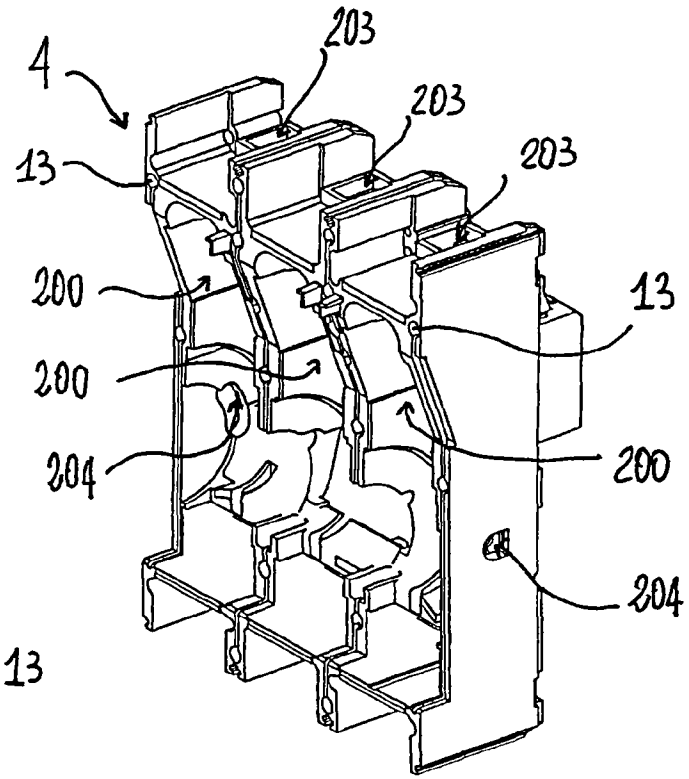
FIGS. 6 and 7 show second perspective views of the parts of an outer casing of a switch indicated in FIGS. 4 and 5.
Figure 8:
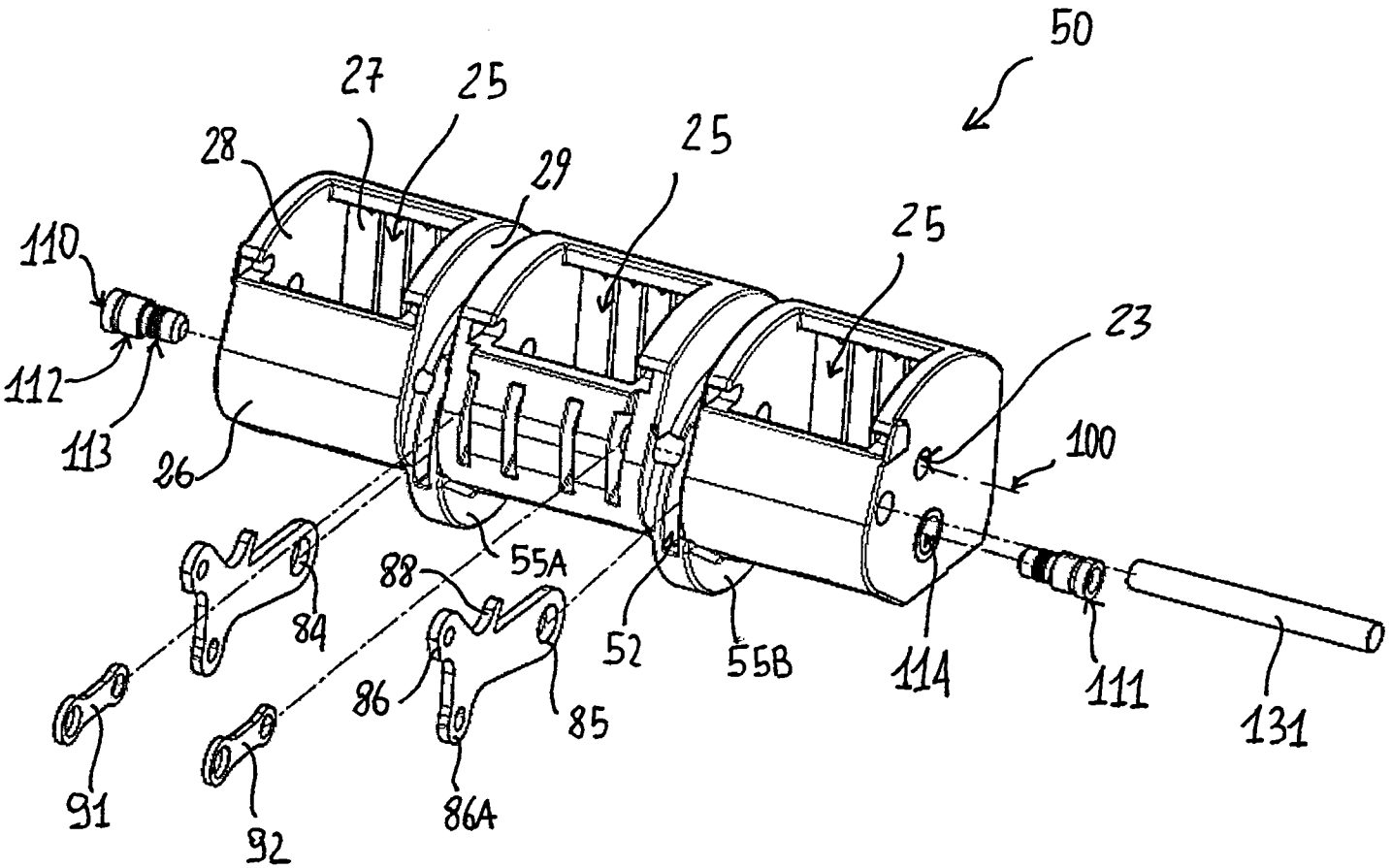
FIGS. 8 and 9 show perspective views of a possible embodiment of a mobile element of a switch according to the invention.
Figure 9:
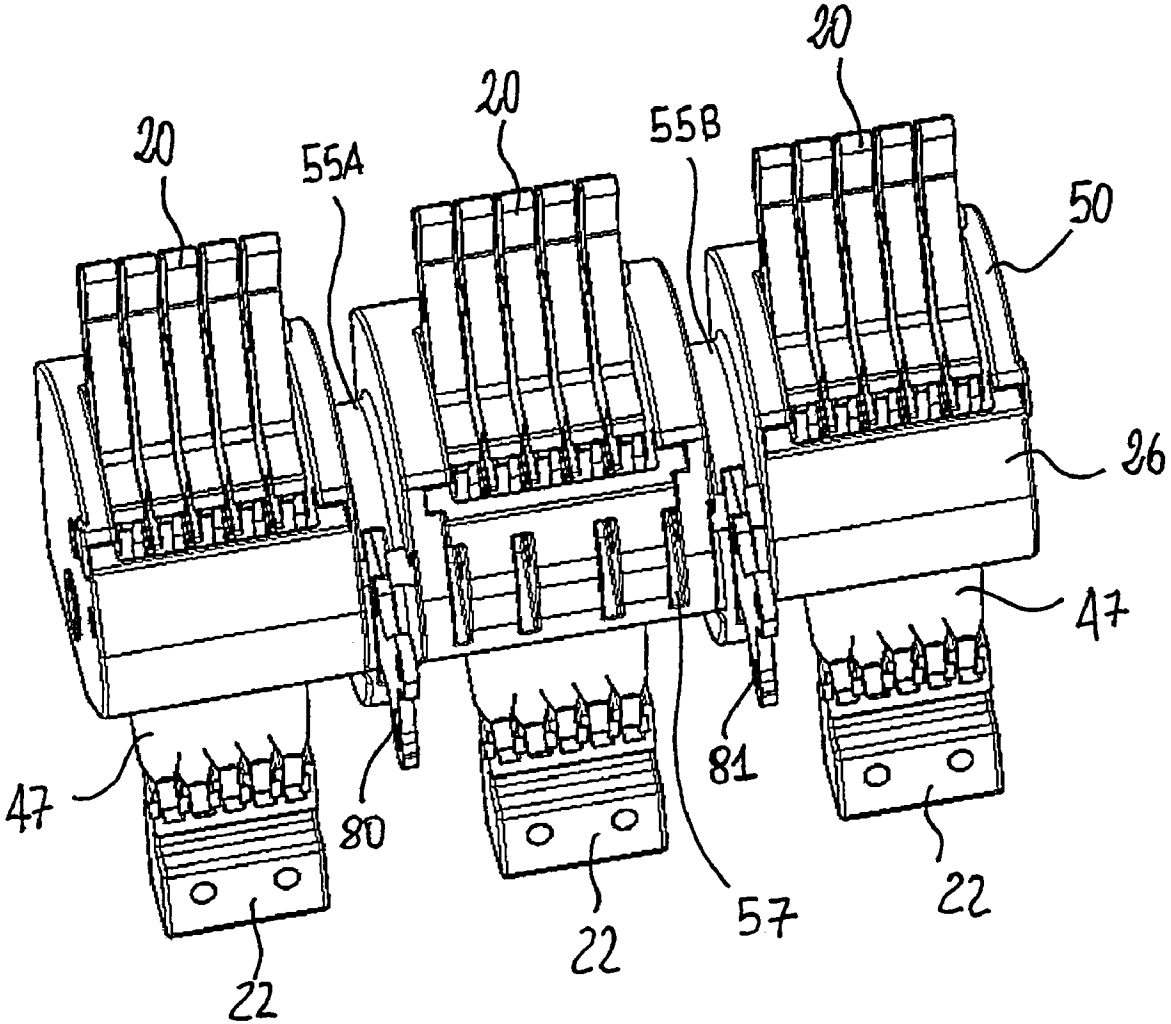

FIGS. 8 and 9 show a possible embodiment of a mobile element 50 according to the invention, and more specifically of an element for a three-pole switch. This does not prevent the technical solutions presented hereunder from also being used for switches with a different number of poles. The mobile element 50 is defined by a shaped body, preferably produced in one piece, which comprises a seat 25 for each pole of the switch 1. Housed in each seat 25 is a mobile contact 20 which can be produced in one piece or in a plurality of components adjacent to one another, as clearly shown in FIG. 7. These seats 25 are produced to be mutually adjacent and in particular positioned so that the mobile contacts 20 housed therein have a common axis of rotation 100. This axis is physically formed of transverse rotation pins (not visible in the figures) which are arranged in suitable housings 23 produced on each of the seats 25.

In a preferred embodiment, the seats 25 are defined essentially by a front wall 26, a rear wall 27, substantially opposite the front wall 26, by a first side wall 28 and a second side wall 29, substantially opposite each other. These walls are mutually positioned to produce at least a first and a second opening, through which the relative mobile contact 20 and electrical connection means 47 project (see FIG. 9). The latter, formed for example of a copper braid, electrically connect the mobile contact 20 to an electrode 22, in turn connected to the electrical network in which the switch 1 is installed. If the switch 1 operates according to the known double break principle, other electric contacts suitable to couple with a further series of fixed contacts identical to the ones indicated above can advantageously project from the second opening.

The mobile element 50 comprises circular connecting parts 55*a* and 55*b* positioned between two adjacent seats 25. In the solution shown in FIGS. 8 and 9, these circular connecting parts 55 emerge for a portion thereof with respect to the spatial volume occupied by the seats 25. This solution must obviously be considered solely as a possible and not entirely exclusive embodiment of the mobile element 50.

Each of these connecting parts 55 comprises at least one radial recess the function of which will be illustrated hereunder. More specifically, the mobile element 50 shown in FIGS. 6 and 7 comprises a first connecting part 55*a* and a second connecting part 55*b*, respectively comprising a first radial recess 51 and a second radial recess 52.

In a preferred embodiment thereof once again illustrated in FIG. 7, the supporting means are formed of at least a first supporting arm 80 and of a second supporting arm 81 having at least two ends placed opposite each other. In particular, each of them comprises at least a first operating end 85 which connects to the mobile element 50 and a second retention end 86 which couples to the structural part 70 of the control mechanism 60 and 61. According to a preferred embodiment, the two supporting arms 80 and 81 have a three lobed configuration comprising a third retention end 86*a* adjacent to said second end 86.

As mentioned above, the supporting means have a dual function of supporting the mobile element 50 with respect to the outer casing 2, and simultaneously providing a center of rotation for said element. The latter function is produced through a hinged connection which permits rotation of the mobile element 50 with respect to the supporting arms 80 and 81 and more generally with respect to the fixed parts of the switch 1.

Figure 10:
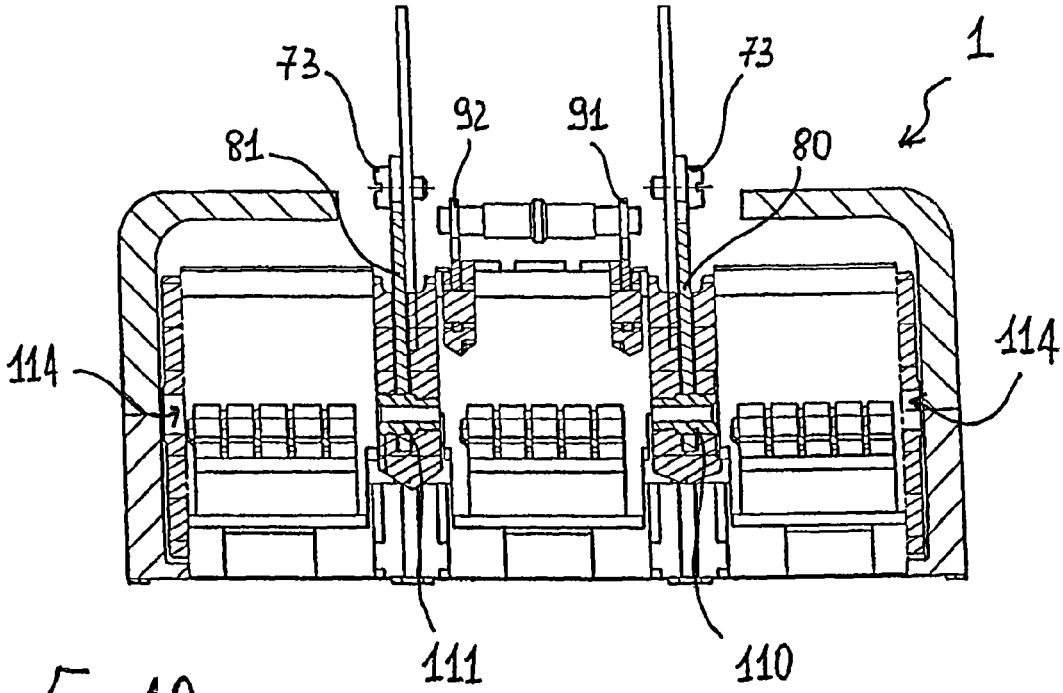
FIG. 10 shows a sectional view of a possible connection of a mobile element to the supporting means of a switch according to the invention.

FIGS. 8 and 10 show a possible embodiment of this hinged connection. Advantageously, it is implemented inside said radial recesses 51 and 52 provided in the connecting parts 55*a* and 55*b* of the mobile element 50.

Figure 11:
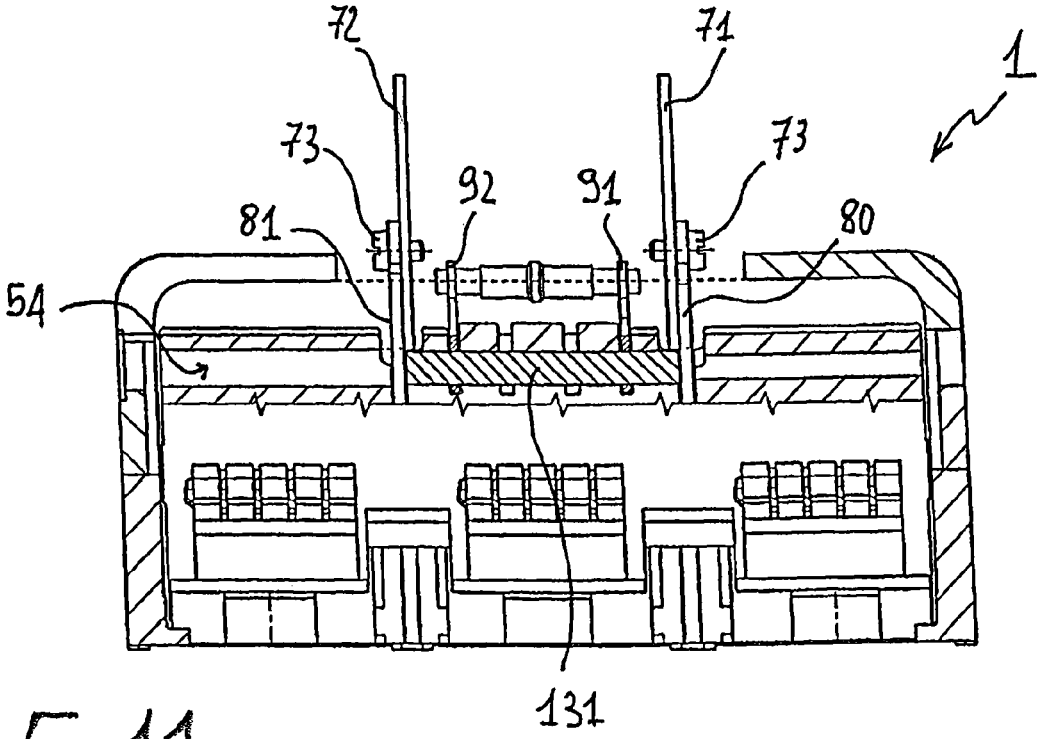
FIG. 11 shows a sectional view of a possible embodiment of said first removable connection means of a switch according to the invention.

With reference in particular to FIG. 6, the hinged connection comprises for each supporting arm 80 and 81 a rotation pin 110 and 111 which is inserted in a first hole 84 produced on the first operating end 85 and in a second hole provided on the mobile element 50. The rotation pins 110 and 111 preferably have at least a first calibrated longitudinal portion 112 which couples to the inner surface of the first hole 84 produced on the relative supporting arm 80 or 81. Each pin advantageously also comprises a second retention portion 113 which is coupled by friction or by screwing in the second hole of the mobile element 50. In practice, the retention portion 113 allows the rotation pin to be positioned in relation to the mobile element 50, while the calibrated portion allows rotation of the element with respect to the supporting arms 80 and 81 that support it. From the point of view of assembly, the solution described is extremely advantageous as each rotation pin has limited axial dimensions which facilitate positioning inside the element 50 at the radial recesses 51 and 52. FIG. 11 shows a sectional view of the connection in question and allows the advantages of this solution to be observed. The rotation pins are placed in their operating positions making use of gaps 114 produced on the side walls of the housing seats 25. The limited axial dimension of the rotation pins 110 and 111 advantageously also improves the mechanical reliability of the connection without detriment to the electrical insulation properties.

With reference again to FIG. 10, the operating ends of the supporting arms 80 and 81 and the radial recesses 51 and 52 of the element 50 are coupled in an extremely accurate way in order to limit clearances. Moreover, the surfaces of the arms 80 and 81 and the inner surfaces of the radial recesses 51 and 52 are compatible with each other to limit phenomena of friction. This contact area in practice acts as a bearing, as it supports the mobile element 50 while allowing rotation also for operating configurations in which the mobile element 50 is installed according to non-horizontal planes.

In FIGS. 1, 8 and 11 a possible embodiment of first connection means 64 according to the invention can be observed. In particular, they comprise a first connecting rod 91 and a second connecting rod 92 which are operatively connected to the mobile element 50 and to the control mechanism 60 or 61 through a transverse driving pin 131. As shown, the connecting rods 91 and 92 are inserted in hollow sectors 57 produced on the front walls of the seats 25 of the mobile element 50 and perforated crosswise to house the transverse driving pin 131. With reference to FIG. 10, the mobile element 50 is perforated crosswise for the entire length thereof to define a through tunnel 54 in which the transverse driving pin 131 is made to slide to reach its operating position. As mentioned above, the outer casing 2 advantageously also comprises side openings 204 which advantageously allow removal or positioning of the transverse driving pin 131. According to a preferred embodiment of the invention, during normal operation of the switch 1, the transverse driving pin 131 is constrained in its correct operating position by the supporting arms 80 and 81 which each have a protruding tooth 88 that stops the pin 131 longitudinally in proximity of the ends thereof, as indicated in FIG. 11. In this embodiment, removal and positioning of the pin 131 will thus be performed by varying the mutual position of the element 50 with respect to the arms 80 and 81 so that each protruding tooth 88 does not block movement of the pin, permitting it to slide along the through tunnel 54.

FIG. 12 is a first exploded view of a first embodiment of the switch 1 according to the invention, comprising a power storage control mechanism 60. In particular, in this figure a possible embodiment of said second (65) and said third removable connection means 66 (indicated in FIG. 1) can be observed.

The second connection means 65 preferably comprise a plurality of axial tie rods 62 which connect the storage control mechanism 60 to the bottom 3 of the outer casing 2. The tie rods 62 are inserted in through holes 33 produced on the bottom 3 and subsequently screwed to the inside of threaded cavities 34, provided on suitable fastening protrusions 78 (see also FIGS. 2 and 3) of the structural part 70 of the control mechanism 60. The axial tie rods 62 can naturally be replaced by other functionally equivalent means and are easily removable when required to allow replacement of the control mechanism.

As indicated above, the third connection means 66 are instead provided for the purpose of connecting the supporting means to the structural part 70 of the control mechanism 60 in a removable way. In the solution shown in FIG. 12, the supporting arms 80 and 81 are preferably connected to the control mechanism 60 on the outer side of each side 71 and 72 using removable screws 73 or other functionally equivalent elements.

From the description hereinbefore, the versatility of the switch 1 according to the invention, on which control mechanisms with different characteristics, operating configurations, making and breaking capacities can be mounted, can be clearly understood.

Figure 13:
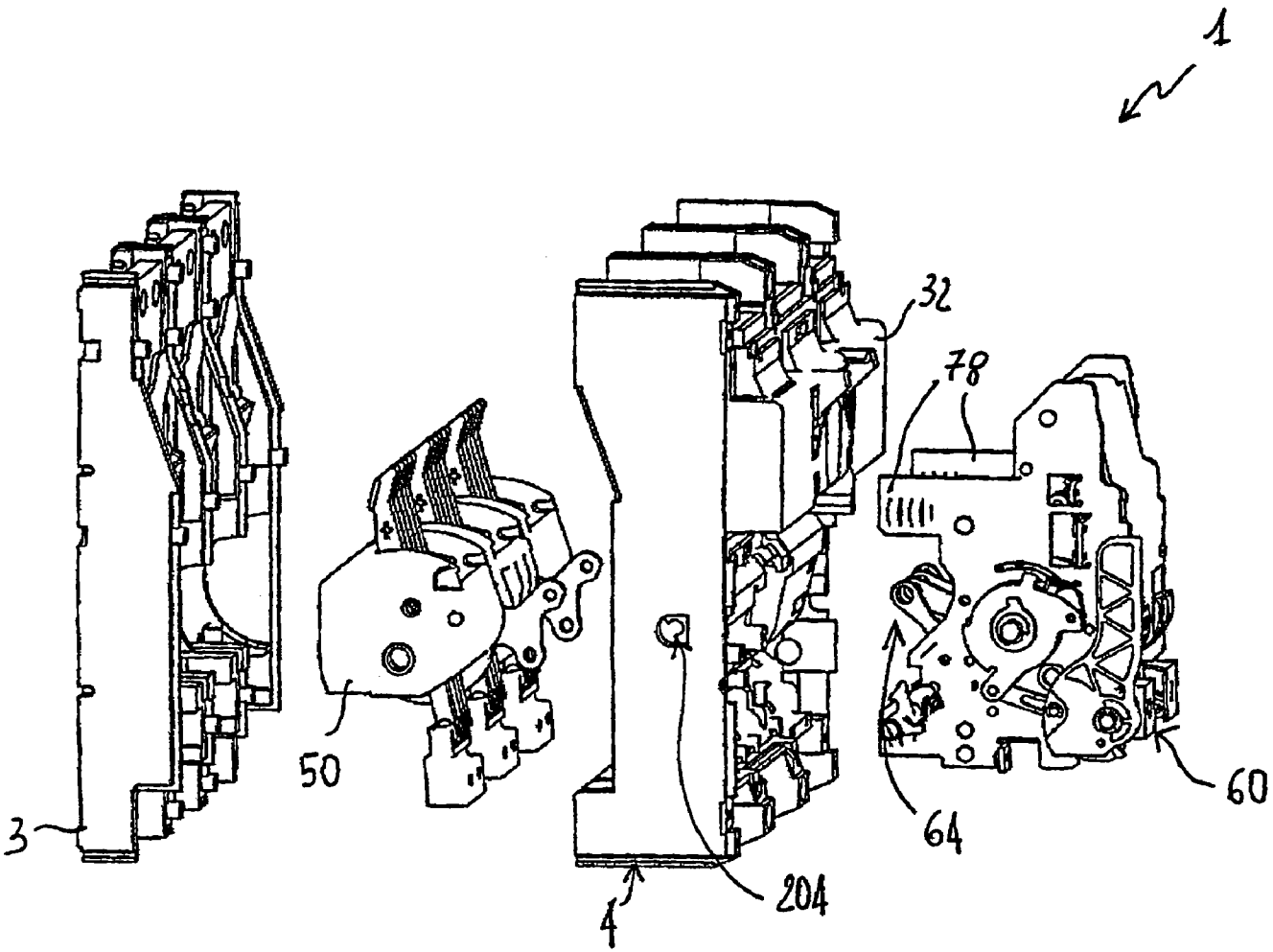

FIG. 13 is a second exploded view of the switch indicated in FIG. 12 in which the methods for the assembly thereof can be observed. In an initial step, the supporting arms 80 and 81 are mounted in the radial recesses 51 and 52, followed by positioning of the mobile contacts 20 in the seats 25 and connection of the two supporting arms 80 and 81 in the radial recesses 51 and 52. In this step the mobile contacts 20 are preferably already connected to the relative electrodes 22 through the specified electrical connection means 21. Subsequently, the mobile element 50 is placed inside the outer casing 2, produced by coupling the bottom 3 and the lid 4 to then be connected to the control mechanism 60. In particular, the connecting rods 91 and 92 are fastened to the element 50 at the level of the hollow sectors 57 thereof and with the use of the transverse driving pin 131. The supporting arms 80 and 81 are then fastened to the sides 71 and 72 of the structure 70 of the control 60 using the removable fastening means 73 at the retention ends 86 and **86*a* provided on said arms. The control 60 is then placed in the correct operating position using the axial tie rods 62 which connect it stably to the bottom 3. The sides 71 and 72 of the control 60 are shaped to correspond with the rear wall of the lid which in practice acts as a spacer between said control and the bottom 3. The presence of the lid 4** made of insulating material also contributes towards improving insulation of the control with respect to the electrical parts.

If the casing is made of sheet metal, as for example in the typical construction of an ACB, the sides of the control structure can be shaped to correspond directly with the bottom of said casing.

Figure 14:
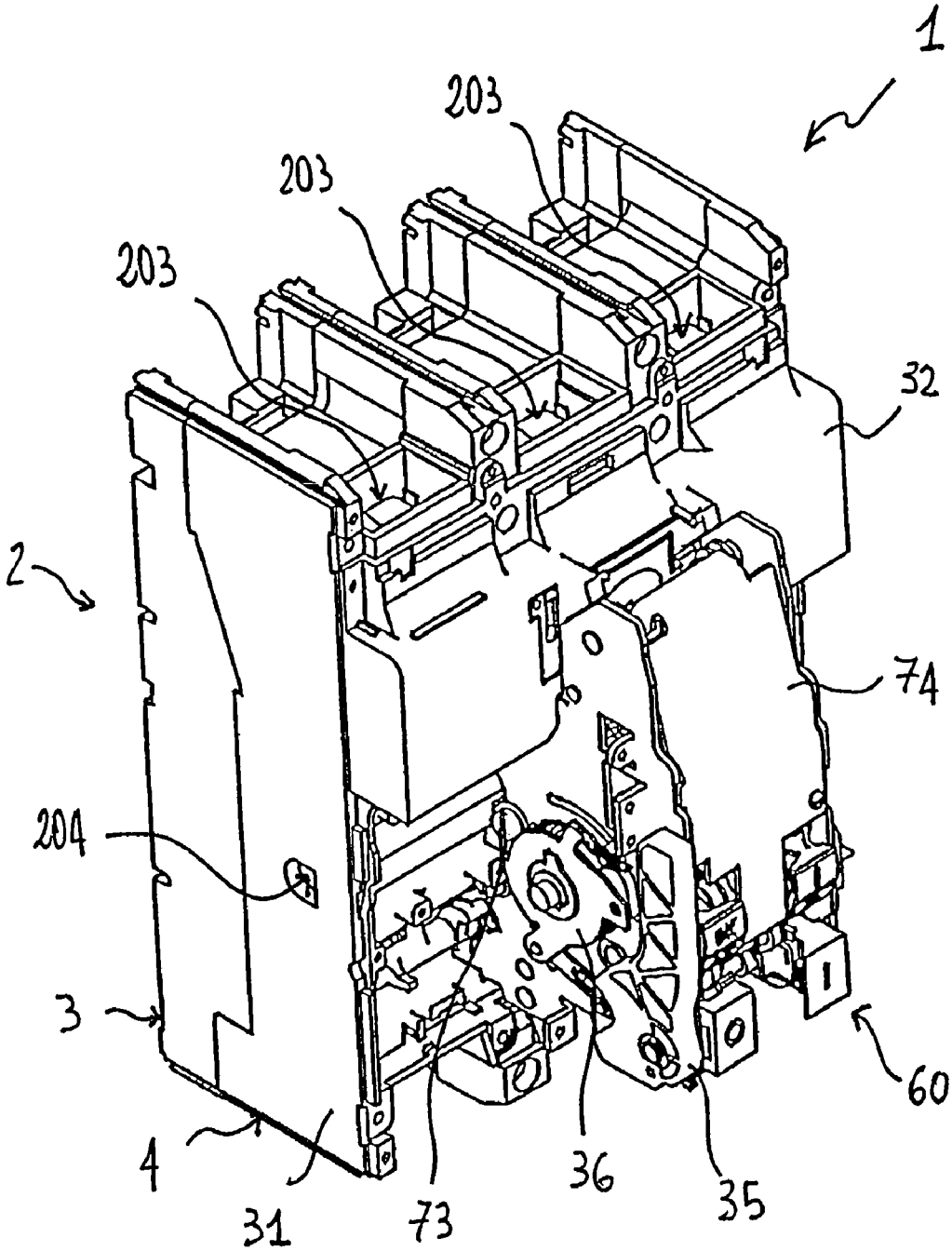
FIG. 14 shows a perspective view of the switch indicated in FIGS. 12 and 13.

FIG. 14 shows the switch 1 at the end of the main assembly steps described above. In particular, one of the side openings 204 produced on the side 31 of the lid 4 which allows access to be gained to the inside of the lid, to permit positioning or removal of the transverse driving pin 131 connecting the control 60 to the mobile element 50, can be observed. With this illustration, it is possible to observe how all the connection means described are easily accessible to operators without requiring disassembly of the casing. The switch 1 is therefore suitable to be easily preset for applications of different types, thanks to the noteworthy characteristics of interchangeability of the control that distinguish it.

Figure 16:
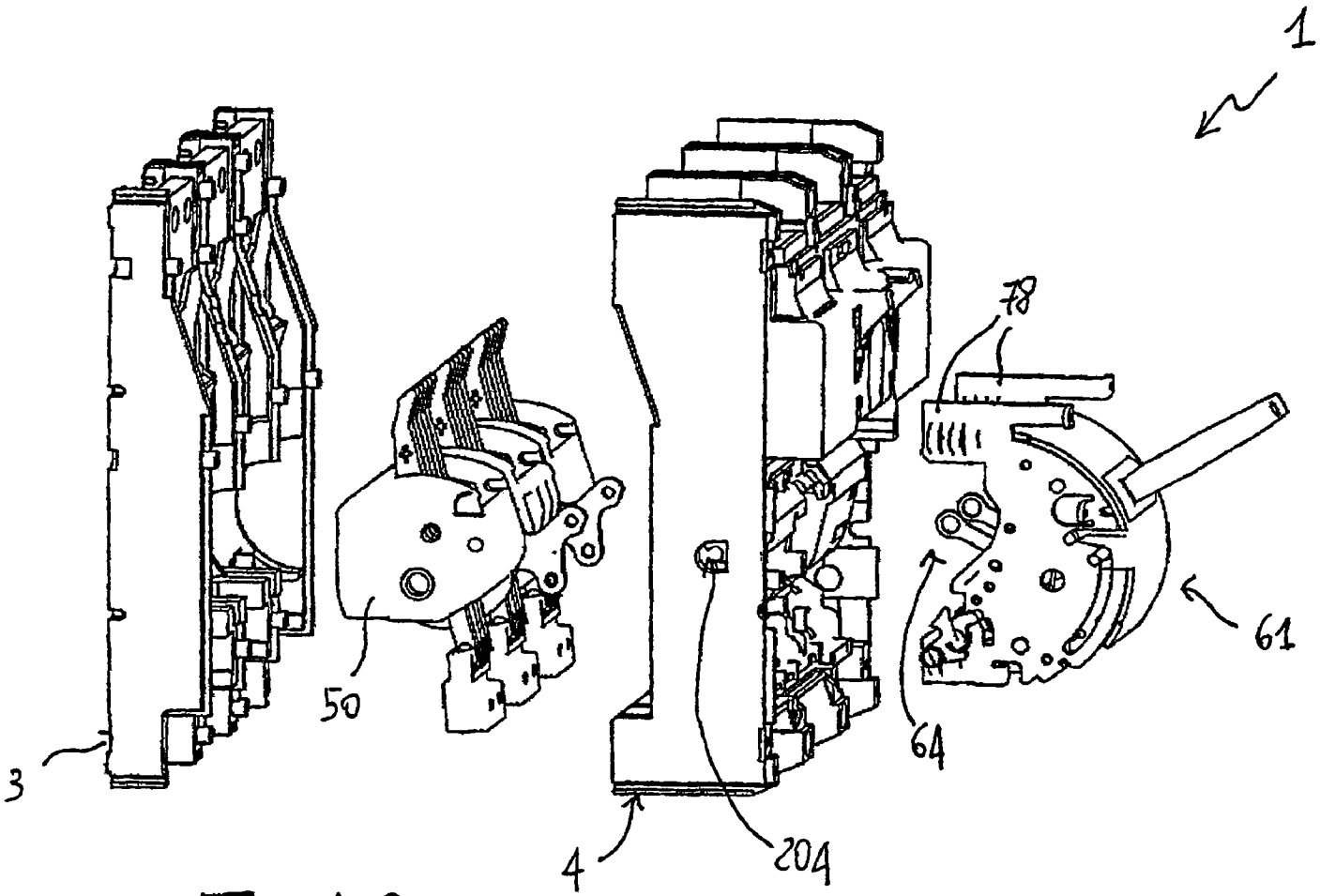
Figure 17:
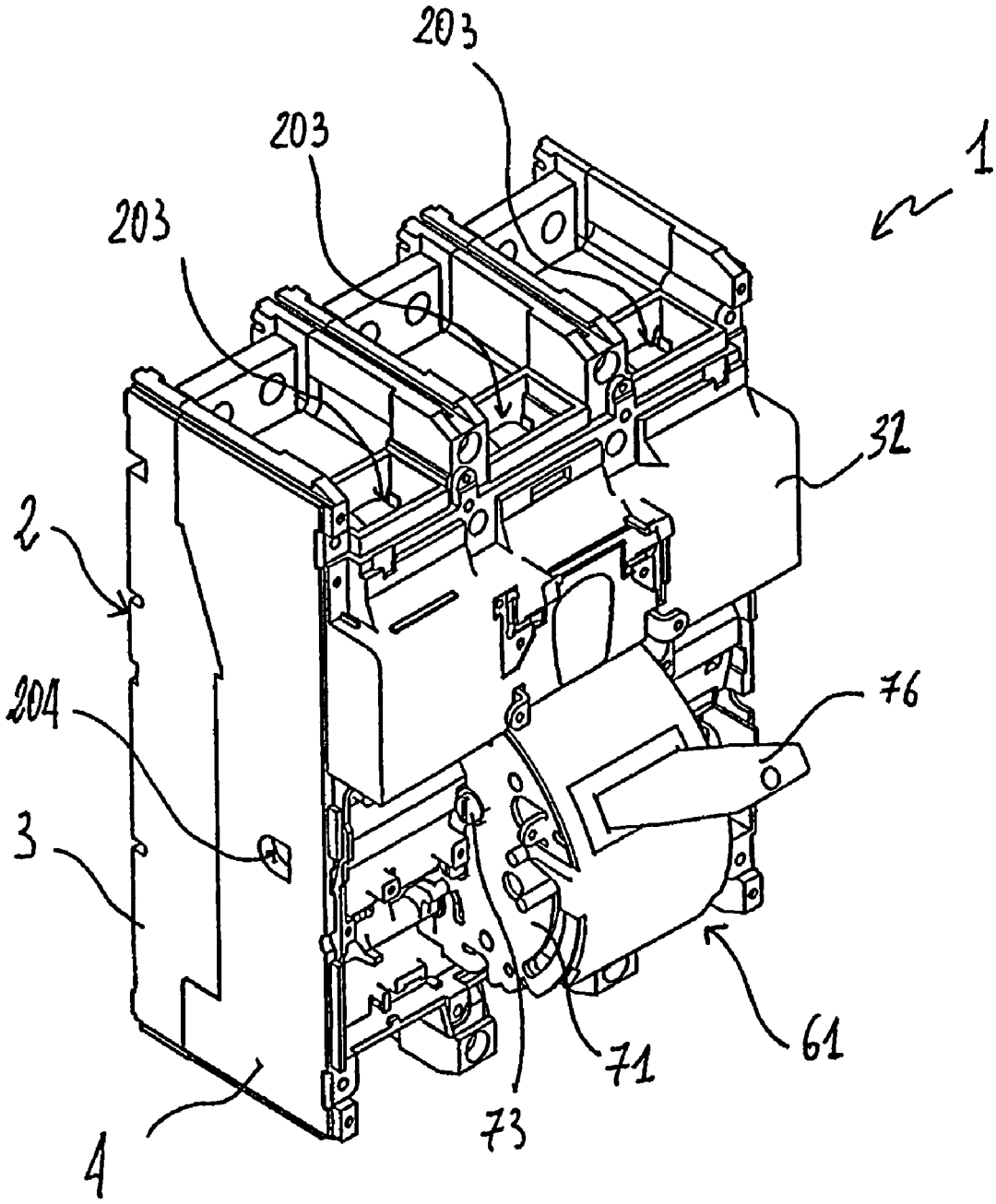
FIG. 17 shows a perspective view of the switch indicated in FIGS. 15 and 16.

FIGS. 15 and 16 are respectively a first and a second exploded view of a second embodiment of a switch 1 according to the invention comprising a control of the direct type 61. In FIG. 15 it is possible to observe how the first, second and third connection means used in the previous case can also be utilized to position the control mechanism of the direct type. Similarly, FIG. 16 shows how the assembly steps of the switch for the two different types of control are exactly the same.

In substance, therefore, a control mechanism of direct type 61 can easily be replaced with one of the power storage type 60, or vice versa, using simple operations and in particular by separating the supporting arms 80 and 81 from the sides 70 and 71 of the control mechanism 60, removing the transverse driving pin 131 and uncoupling the control mechanism 60 from the bottom 3 of the casing 2 by removing the tie rods 62.

With reference to the first connection means 64, it must be observed that the interchangeability of the control is also guaranteed by the presence of a plurality of hollow sectors 57 which is particularly advantageous as it allows positioning of the connecting rods 91 and 92 at variable distances according to the type of control used. Alternatively to the hollow sectors 57, perforated radial protrusions for insertion of the transverse driving pin 131 could be provided.

However, said transverse driving pin 131 must be arranged in an eccentric position with respect to the axis of rotation of the mobile element 50 provided by the hinge connection. In this way, subsequent to a movement of the transverse driving pin 131 a torque is generated that makes the element 50, and consequently the mobile contacts 20, rotate.

The technical solutions adopted for the switch according to the invention thereby allow the tasks and objects set to be completely fulfilled. The switch has an easy to assemble compact inner structure composed of a limited number of components. The use of supporting means makes it possible to limit the friction areas, improving the mechanical efficiency of the switch. The use of removable connection means between operating parts of the switch allows easy interchangeability of the control, permitting the switch to be used in different applications.

The switch thus conceived is susceptible of numerous modifications and variants, all coming within the scope of the inventive concept; moreover, all details can be formed of other technically equivalent details. In practice, the materials used and the dimensions and contingent shapes can be any, according to requirements and to the state of the art.

The invention claimed is:

1. A switch (1) for low-voltage systems including an outer casing (2) containing for each pole at least one fixed contact (10) and at least one mobile contact (20) which can be reciprocally coupled to/uncoupled from each other, a mobile element (50) defined by a shaped body comprising at least one seat (25) for each pole of said switch (1), said seat (25) being suitable to house the mobile contact (20) of the relative pole, the switch comprising:

first removable connection means (64) which connect a control mechanism (60, 61) to said mobile element (50), said control mechanism (60, 61) comprising mechanical means supported by a structural part (70);

second removable connection means (65) which connect said structural part (70) of said control mechanism (60, 61) to said outer casing (2); and means to support said mobile element (50) connected to said structural part (70) of said control mechanism (60, 61) through third removable connection means (66), said supporting means being connected to said mobile element (50) through a hinge connection, wherein said structural part (70) of said control mechanism (60, 61) comprises at least a first side (71) and a second side (72) between which said mechanical means are interposed, and wherein said second removable connection means (65) comprise axial tie rods (62).

2. The switch (1) as claimed in claim 1, wherein said outer casing (2) comprises a bottom (3) which couples to a lid (4) through coupling surfaces (6*a*, 6*b*) geometrically corresponding with each other.

3. The switch (1) as claimed in claim 1, wherein said mobile contacts (20) are mounted on a plurality of transverse rotation pins aligned and arranged on housings (23) produced in said side walls (28, 29) of said seats (25).

4. The switch (1) as claimed in claim 1, wherein said axial tie rods (62) are screwed in threaded cavities (34) provided on fastening protrusions (78) of said structural part (70) of said control mechanism (60, 61).

5. The switch (1) as claimed in claim 1, wherein said supporting arms (80, 81) each comprise at least a first operating end (85) connected to said mobile element (50) through said hinged connection and a second retention end (86) coupled to said structural part (70) of said control mechanism (60, 61) through said third removable connection means (66).

6. The switch (1) as claimed in claim 1, wherein said supporting arms (80, 81) have a three lobed configuration.

7. The switch (1) as claimed in claim 1, wherein said first operating end (85) of each supporting arm (80, 81) is inserted in one of said radial recesses (51, 52) of said mobile element (50) to be connected thereto through said hinged connection.

8. The switch (1) as claimed in claim 1, wherein said supporting means comprise a first (80) and a second supporting arm (81).

9. The switch (1) as claimed in claim 1, wherein said mobile element (50) is made of thermosetting resin.

10. The switch (1) as claimed in claim 1, wherein said control mechanism is of the power storage type (60).

11. The switch (1) as claimed in claim 1, wherein said control mechanism is of the direct type (61).

12. The switch (1) as claimed in claim 1, wherein said mobile element (50) comprises a plurality of seats (25) adjacent to one another, interposed between which are connecting parts (55*a*, 55*b*) at which said supporting means are operatively connected to said mobile element (50).

13. The switch as claimed in claim 12, wherein said mobile element (50) comprises a first circular connecting part (55*a*) and a second circular connecting part (55*b*), each positioned between two adjacent seats, said first part (55*a*) and said second part (55*b*) respectively comprising a first radial recess (51) and a second radial recess (52).

14. The switch (1) as claimed in claim 12, wherein each of said seats (25) is defined by a front wall (26), a rear wall (27) substantially opposite said front wall (26), a first side wall (28) and a second side wall (29), substantially opposite each other, said surfaces (26, 27, 28, 29) defining at least a first and a second opening, respectively projecting from which are said mobile contacts (20) and connecting means (47) suitable to electrically connect said mobile contacts (20) to respective electrodes (22) of said switch (1).

15. The switch (1) as claimed in claim 1, wherein said first removable connection means (64) comprise a first (91) and a second connecting rod (92).

16. The switch (1) as claimed in claim 15, wherein said first (91) and said second connecting rod (92) are operatively connected to said mobile element (50) through a transverse driving pin (131).

17. The switch (1) as claimed in claim 16, wherein said lid (4) of said outer casing (2) comprises at least one opening (204) suitable to allow removal or positioning of said transverse driving pin (131).

18. The switch (1) as claimed in claim 17, wherein said hinged connection means comprise for each supporting arm (80, 81) a rotation pin (110, 111) which is inserted in a first hole (84) produced on said operating end (85) and in a second hole provided on the mobile element (50).

19. The switch (1) as claimed in claim 18, wherein said first rotation pin (110) and/or said second rotation pin (111) comprise at least a first calibrated longitudinal portion (112) and at least a second retention longitudinal portion (113), said first calibrated portion (112) being suitable to couple with clearance with the inner surface of said first hole (83), said second retention portion (113) being suitable to be inserted by friction or screwing in said second hole of said mobile element (20).

20. The switch (1) as claimed in claim 1, wherein said third removable connection means (66) are formed of threaded screws (73).

21. The switch (1) as claimed in claim 20, wherein said third removable connection means (66) connect said supporting means to an outer side of said first (71) and of said second side (72) of said structural part (70).

* * * * *